US007831175B2

(12) United States Patent
Moon et al.

(10) Patent No.: US 7,831,175 B2
(45) Date of Patent: Nov. 9, 2010

(54) DEVELOPER CARTRIDGE GUIDE UNIT AND IMAGE FORMING APPARATUS HAVING THE SAME

(75) Inventors: Ji-won Moon, Suwon-si (KR); Ki-jae Do, Suwon-si (KR)

(73) Assignee: Samsung Electronics Co., Ltd, Suwon-si (KR)

( * ) Notice: Subject to any disclaimer, the term of this patent is extended or adjusted under 35 U.S.C. 154(b) by 439 days.

(21) Appl. No.: 11/934,872

(22) Filed: Nov. 5, 2007

(65) Prior Publication Data

US 2008/0317507 A1 Dec. 25, 2008

(30) Foreign Application Priority Data

Jun. 19, 2007 (KR) ..... 10-2007-0060003

(51) Int. Cl.
*G03G 15/08* (2006.01)

(52) U.S. Cl. ..... 399/119; 399/258; 399/224

(58) Field of Classification Search ..... 399/119, 399/222, 262, 258, 224, 261
See application file for complete search history.

(56) References Cited

U.S. PATENT DOCUMENTS 5,172,168 A * 12/1992 Satoh et al. ..... 399/224
5,404,211 A * 4/1995 Hashimoto et al. ..... 399/126
6,628,908 B2 * 9/2003 Matsumoto et al. ..... 399/106
6,795,660 B2 * 9/2004 Yugeta et al. ..... 399/27
7,110,707 B2 * 9/2006 Nishitani ..... 399/258
2004/0120733 A1 * 6/2004 Aoki et al. ..... 399/270
2005/0226655 A1 * 10/2005 Katsuyama et al. ..... 399/258
2006/0210310 A1 * 9/2006 Takahashi et al. ..... 399/149
2007/0116495 A1 * 5/2007 Kimura et al. ..... 399/258
2007/0154236 A1 * 7/2007 Kwon ..... 399/114
2008/0292363 A1 * 11/2008 Moon et al. ..... 399/258

FOREIGN PATENT DOCUMENTS

JP 8-101616 4/1996
JP 2000-258983 9/2000
KR 1999-55986 7/1999

* cited by examiner

*Primary Examiner*—David M Gray
*Assistant Examiner*—G. M. Hyder
(74) *Attorney, Agent, or Firm*—Stanzione & Kim LLP

(57) ABSTRACT

A developing unit of an image forming apparatus includes a developing member to develop an electrostatic latent image on a photosensitive medium with a developer, a first feed member to feed the developer to the developing member, and a reset member disposed above the developing member to reset the developing member. Accordingly, expenditure for consumables is reduced, because a developer cartridge is separately provided. Additionally, efficient developer agitation is provided. Furthermore, a consistent image quality is achieved, because a plurality of augers move vertically and horizontally to circulate the developer inside the developing unit.

26 Claims, 6 Drawing Sheets

DEVELOPER CARTRIDGE GUIDE UNIT AND IMAGE FORMING APPARATUS HAVING THE SAME

CROSS-REFERENCE TO RELATED APPLICATIONS

This application claims priority under 35 U.S.C. §119 (a) from of Korean Patent Application No. 10-2007-0060003, filed on Jun. 19, 2007, in the Korean Intellectual Property Office, the disclosure of which is hereby incorporated herein in its entirety by reference.

BACKGROUND OF THE INVENTION

1. Field of the Invention

The present general inventive concept relates to an image forming apparatus, and more particularly, to a developing unit to develop an electrostatic latent image on a photosensitive medium with developer, and an image forming apparatus having the same.

2. Description of the Related Art

FIGS. 1 and 2 illustrate an example of an image forming apparatus.

In particular, FIGS. 1 and 2 illustrate a color image forming apparatus, which includes a paper feeding unit 10, a plurality of developing units 20, a transfer unit 30, a fusing unit 40, and a paper discharge unit 50.

In such a color image forming apparatus, a sheet of paper is picked up from the paper feeding unit 10, and conveyed past through the developing unit 20 and the transfer unit 30. Accordingly, an image is printed on a surface of the paper sheet, and fixed at the fusing unit 40. After that, the printed paper is discharged out of the image forming apparatus via the paper discharge unit 50.

FIG. 2 illustrates the developing unit 20 in an enlargement view, in which each of the color developing units 20 includes a developing roller 21, a photosensitive medium 22, and a cleaning unit 27 integrally. The developing unit 20 houses developer therein. In such a conventional developing unit 20, it is necessary to agitate the developer sufficiently, before feeding the developer to the developing roller 21, because the developer may inherently develop problems like developer agglomeration and subsequent generation of vertical stripes in printing.

In the implementation of a small image forming apparatus, the developing roller 21, the photosensitive medium 22, and the cleaning unit 27, whether they are in an integrated or separate structure, may have a similar length of lifespan. In certain types of image forming apparatus, however, for example, in an image forming apparatus for office use, generally a large volume of documents are printed out, using up the developer earlier than other components such as a photosensitive medium 22 or a cleaning unit 27 reach their expiration date. This is particularly problematic if all of the components are formed integrally, because other components that can still be used is disposed altogether, to be replaced with a new one having developer therein. Therefore it is important to prepare a removable type of developer cartridge which allows replenishment of developer alone, to save a user's expenditure.

Although the removable type of developer cartridge helps save the user's expenditure for consumables, this type of cartridge can have problems.

That is, a developer feeding unit has to be provided separately, to feed the developer from the developer cartridge to the developing unit. A new agitating structure also has to be provided, to agitate the developer in a manner compatible to the structure of the developer feeding unit, because as mentioned above, printing quality may deteriorate unless the developer is agitated sufficiently.

SUMMARY OF THE INVENTION

The present general inventive concept provides a developing unit having an agitating unit of an improved structure to agitate developer sufficiently, and having a separate developer cartridge to save cost for consumables, and an image forming apparatus having the same.

Additional aspects and utilities of the present general inventive concept will be set forth in part in the description which follows and, in part, will be obvious from the description, or may be learned by practice of the general inventive concept.

The foregoing and other aspects and utilities of the present general inventive concept may be achieved by providing a developing unit usable with an image forming apparatus, the developing unit including a developing member to develop an electrostatic latent image on a photosensitive medium with developer, a first feed member to feed the developer to the developing member, and a reset member disposed above the developing member to reset the developing member.

The reset member and the photosensitive medium may be at a distance in a range from about 0.3 mm to about 0.7 mm away from each other, and the photosensitive medium and the developing member may be at a distance in a range from about 0.1 mm to about 0.3 mm away from each other, respectively.

The developing unit may further include a recovery unit to agitate developer being recovered from the reset member and to transport the developer.

The recovery unit may include a recovery casing housing a cleaning blade to clean the reset member therein, a recovery auger to transport the developer being recovered by the cleaning blade, and a recovery agitating member to agitate the developer recovered. The reset member may form one of a plurality of sidewalls of the recovery unit.

The reset member, if in contact with the developing member, may have a linear velocity in an approximately ±10% range.

The developing unit may further include a second feed member placed at a height lower than a rotational axis of the first feed member.

The developing unit may include a removable developer cartridge.

The developing unit may further include a developer feed passage to feed developer of the developer cartridge to the developing cartridge, and a developer replenish unit, connected with a connecting area between the developing cartridge and the developer feed passage, to agitate developer fed along the developer feed passage, and to feed the agitated developer to the developing cartridge.

The reset member and the photosensitive medium may be at a distance in a range from about 0.3 mm to about 0.7 mm away from each other, and the photosensitive medium and the developing member may be at a distance in a range from about 0.1 mm to about 0.3 mm away from each other, respectively. The reset member, if in contact with the developing member, may have a linear velocity in an approximately ±10% range.

The developing cartridge may further include a second feed member placed at a height lower than a rotational axis of the first feed member.

The developer replenish unit may include a developer feed trench arranged along a length of the developing cartridge, to receive developer being fed along the developer feed passage, and an agitator to transport the received developer along the developer feed trench.

The developer replenish unit may further include a plurality of developer feed holes pierced in the developer feed trench at predetermined intervals from each other, to discharge the developer to the developing cartridge.

The plurality of developer feed holes may be slits formed at predetermined angles with respect to rotational axis of the agitator.

The plurality of developer feed holes may be placed in a position that does not face the developing member.

The developer feed passage may be made from a flexible material, and may be connected with the developer cartridge and with one end of the developing cartridge, respectively.

The developer cartridge may include a plurality of first agitating members, and a second agitating member to agitate developer being discharged to the developer feed passage.

The second agitating member may be disposed proximate to an entrance to the developer feed passage.

The developing cartridge may include a plurality of augers to agitate developer being fed from the developer replenish unit, and a developer layer regulating member, formed below the developing member and in contact with the developing member, to regulate a thickness of developer layer attached to a surface of the developing member.

The plurality of augers may be formed in a same diameter, and may include first and second augers to convey fed developer in opposite directions.

The first auger may be placed in a position to face the developer feed holes, and the second auger may be placed below the first auger.

The first feed member may be placed at a height lower than the first auger and above the second auger, and the second feed member may be placed at a height lower than the second auger.

The first feed member may be placed in a position to face the developing member, and the second feed member may be placed in a position to face the first feed member.

The developing member, the reset member, and the first and second feed members may be implemented as roller members.

The first and second feed members, the developing member, the reset member, and the developer layer regulating member receive a predetermined level of voltage such as AC/DC voltage.

The developing member, the first and second feed members, and the first and second augers may correspond to each other in length.

The developer feed trench may be placed in a position where its lowermost end is at a height above a rotational axis of the first feed member.

A reference developer level may be above the developer feed holes.

The developer may be a uni-component, non-magnetic developer.

The foregoing and other aspects and utilities of the present general inventive concept may be achieved by providing an image forming apparatus, including a main body to form an appearance of the image forming apparatus, and a developing unit mounted in the main body, and configured in the manner explained above to form an image onto a recording medium.

For color printer implementation, at least four developing units may be provided.

The foregoing and other aspects and utilities of the present general inventive concept may be achieved by providing a developing unit usable with an image forming apparatus, the developing unit including a removable developer cartridge, a developing cartridge disposed below the developer cartridge, and including a developing roller, a reset roller to reset the developing roller, a first feed roller disposed at a height lower than the developing roller, one or more augers, and a developer layer regulating member to regulate developer layer on the surface of the developing roller, a developer feed passage made from a flexible mater, to connect the developer cartridge and the developing cartridge, and to feed developer of the developer cartridge to the developing cartridge, and a developer replenish unit, connected with a connecting area between the developing cartridge and the developer feed passage, to agitate developer fed along the developer feed passage, and to feed the agitated developer to the developing cartridge. The reset roller may be disposed above a rotational axis of the developing roller to form one of a plurality of sidewalls of the developer replenish unit, to reset the developing member, and the reset roller is not submerged in the developer. The developer layer regulating member may be disposed below the developing roller.

The developing cartridge may further include a second feed roller disposed below a rotational axis of the first feed roller.

The auger may be formed in a same diameter, and may include first and second augers to convey fed developer in opposite directions. The first auger may be placed in a position to face the developer feed holes, and the second auger may be placed below the first auger.

The developer replenish unit may be arranged in a lengthwise direction of the developing cartridge, and may include a developer feed trench disposed along a length of the developing cartridge, to receive developer being fed along the developer feed passage, and an agitator to transport the received developer along the developer feed trench.

The developer replenish unit may further include a plurality of developer feed holes pierced in the developer feed trench at predetermined intervals from each other, to discharge the developer to the developing cartridge.

The foregoing and other aspects and utilities of the present general inventive concept may be achieved by providing a reset member usable with an image forming apparatus, the reset member including a reset portion disposed above a developing member to reset the developing member wherein the reset portion is not desirably submerged in developer in its initial position. The reset member may be formed opposite to a developer feed member that feeds developer to a developing member which is interposed between the reset member and the developer feed member, and the reset member, along with the developing member and the developer feed member, may be formed as roller members.

The foregoing and other aspects and utilities of the present general inventive concept may also be achieved by providing a developing unit usable with an image forming apparatus, the developing unit including a developing cartridge having a photosensitive medium to form an electrostatic image thereon and a developing member to provide developer to the photosensitive medium and a developer feeding passage having a developer cartridge receiving portion on one end and an other end connected to the developing cartridge, wherein a detachably mounted developer cartridge having one or more agitators attaches to the other end of the developer feeding passage.

BRIEF DESCRIPTION OF THE DRAWINGS

These and/or other aspects and utilities of the present general inventive concept will become apparent and more readily appreciated from the following description of the embodiments, taken in conjunction with the accompanying drawings of which.

DETAILED DESCRIPTION OF THE PREFERRED EMBODIMENTS

Figure 1:
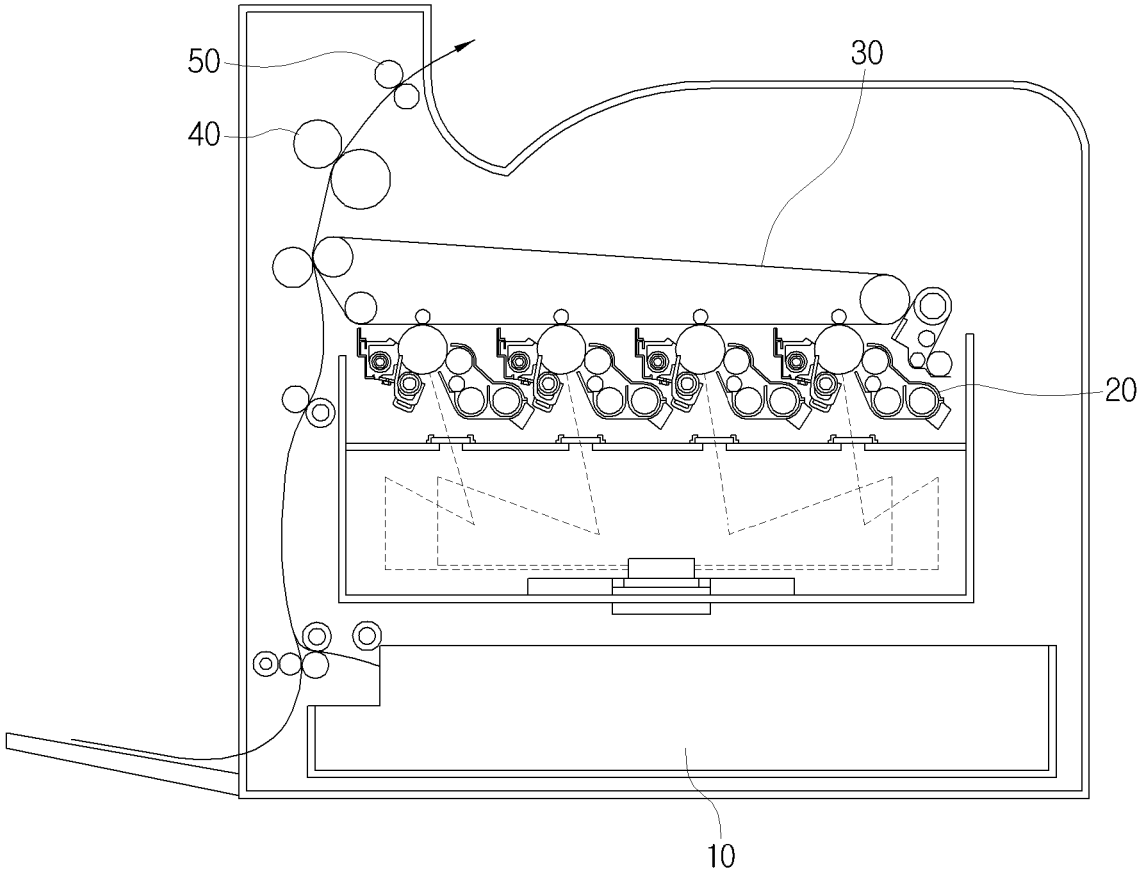
FIG. 1 (PRIOR ART)
FIG. 1 illustrates an example of a conventional image forming apparatus.
Figure 2:
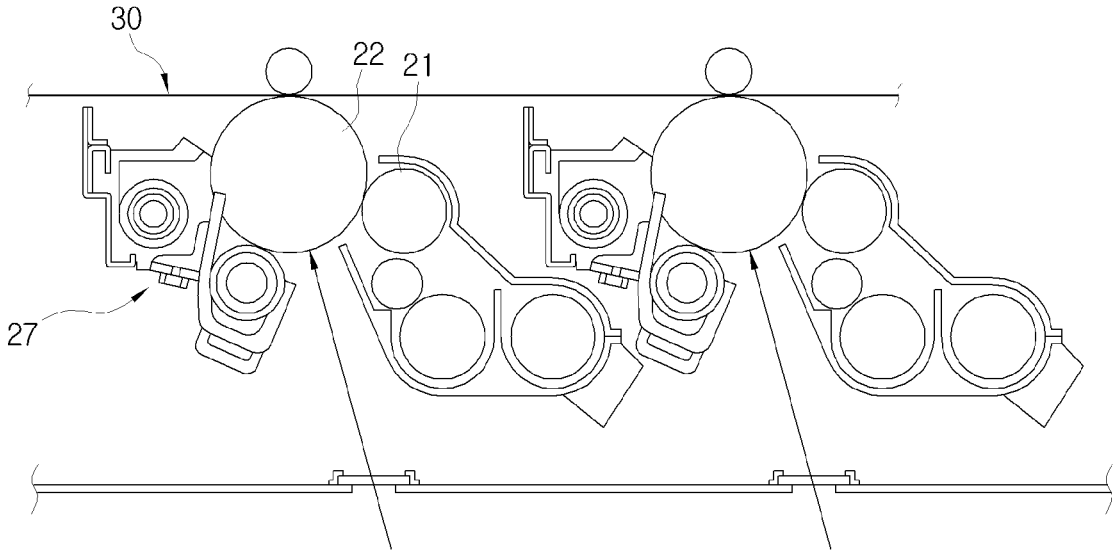
FIG. 2 (PRIOR ART)
FIG. 2 illustrates the developing unit of FIG. 1.

Reference will now be made in detail to embodiments of the present general inventive concept, examples of which are illustrated in the accompanying drawings, wherein like reference numerals refer to the like elements throughout. The embodiments are described below in order to explain the present general inventive concept by referring to the figures.

Figure 3:
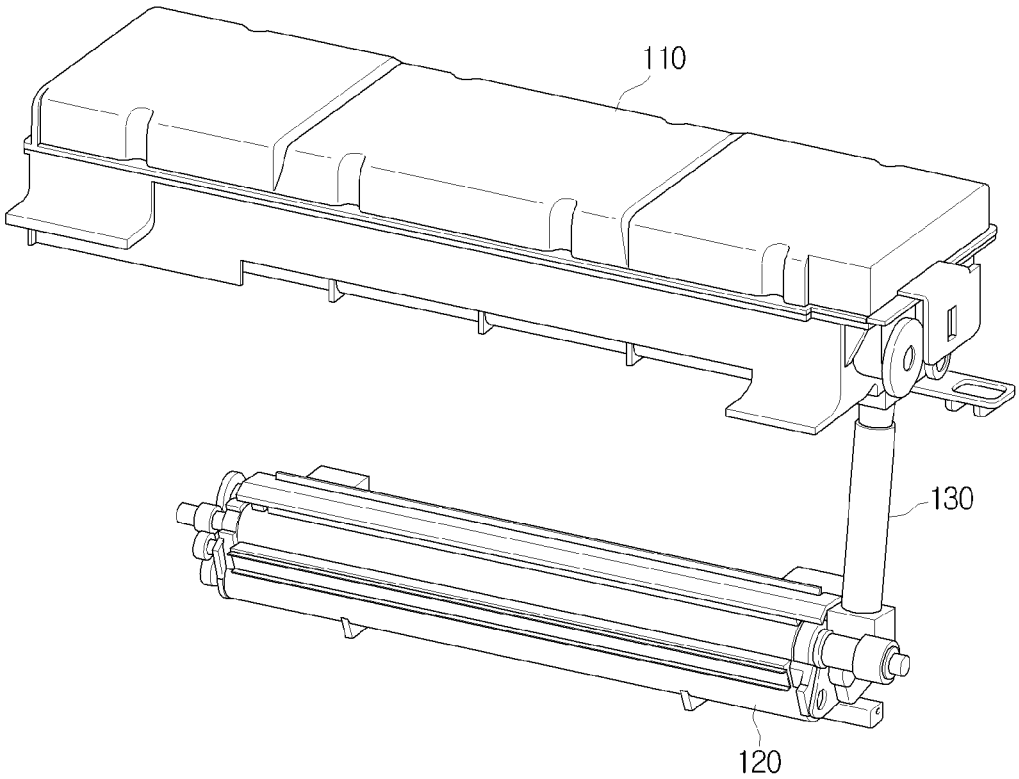
FIG. 3 is a perspective view illustrating a developing unit of an image forming apparatus according to an example embodiment of the present general inventive concept.
Figure 4:
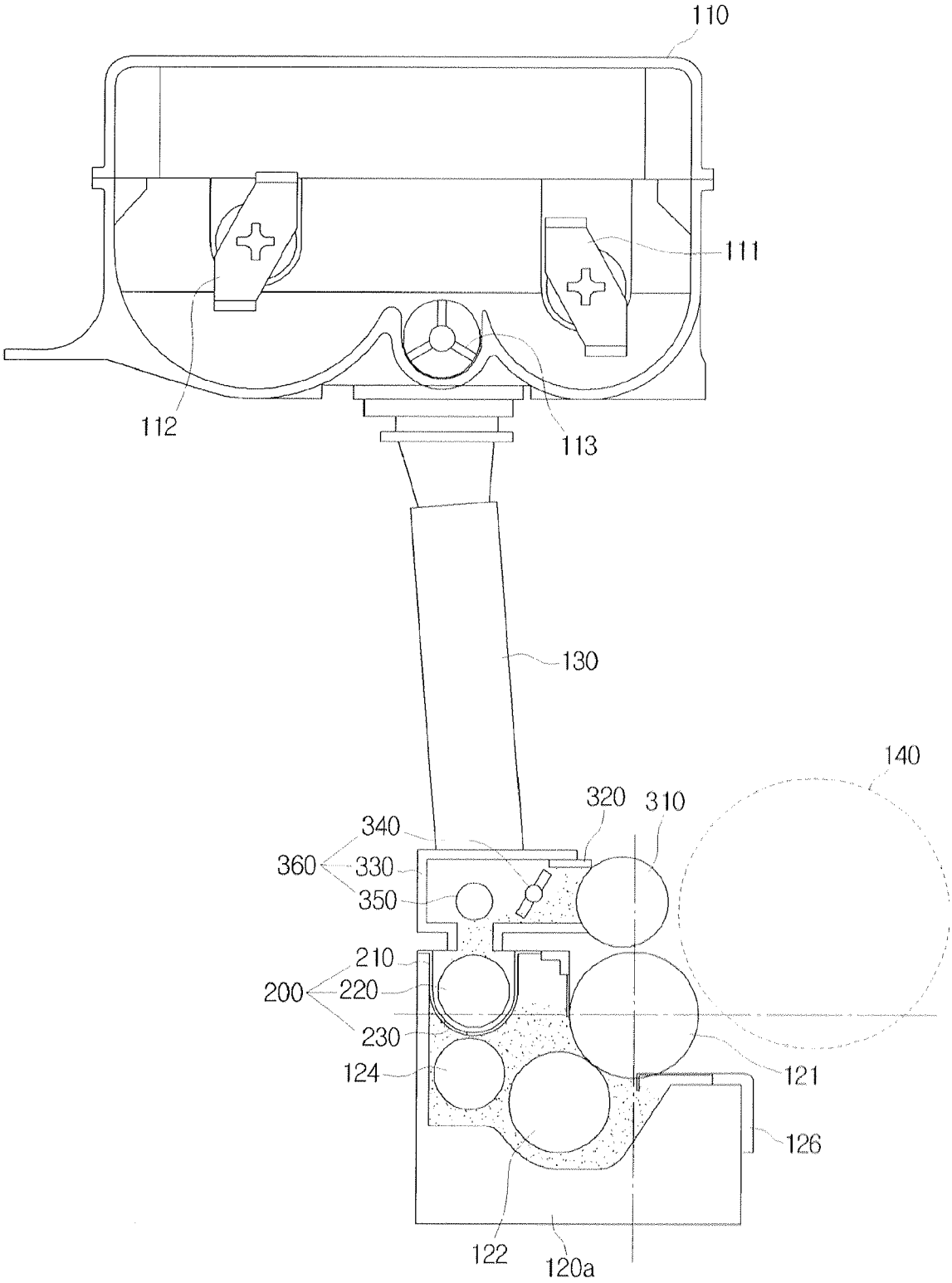
FIG. 4 is a cross section view of FIG. 3 according to another example embodiment of the present general inventive concept.

Referring to FIGS. 3 and 4, a developing unit according to an example embodiment of the present general inventive concept includes a developer cartridge 110, a developing cartridge 120, a developer feeding passage 130, a developer replenish unit 200, and a reset member 310.

The developer cartridge 110 can contain therein developer such as uni-component nonmagnetic developer. The developer cartridge 110 includes a plurality of first agitating members 111 and 112, and a second agitating member 113. The first agitating members 111 and 112 agitate the developer to prevent possible agglomeration of the developer. The second agitating member 113 sends the developer to the developer feeding passage 130 after the agitating at the first agitating members 111 and 112.

The developing cartridge 120 is placed below the developer cartridge 110 at a predetermined distance, to allow other components of the image forming apparatus such as a laser scanning unit (not illustrated) or a control panel to be arranged between the developer cartridge 110 and the developing cartridge 120. The developing cartridge 120 includes a developing casing 120*a*, a developing member 121 mounted in the developing casing 120*a*, a first feeding member 122, a first auger 124, a developer layer regulating member 126, and a photosensitive medium 140. The structure of the developing cartridge 120 will be explained in detail below.

Referring to FIGS. 3 and 4, the developer feeding passage 130 may be arranged such that one end is connected with the developer cartridge 110 and the other end is connected with the developing cartridge 120. By doing so, other components such as laser scanning unit can be arranged in a space between the developer cartridge 110 and the developing cartridge 120, thus helping accomplish compactness of the image forming apparatus. The developer feeding passage 130 may be made from a flexible material to facilitate assembly and developer supply.

The developer replenish unit 200 includes a developer feed trench 210, an agitator 220, and a plurality of developer feed holes 230.

The developer feed trench 210 can be sized to have a length that corresponds to a width of the developing cartridge 120, contains the developer being fed through an injection portion of the developer feed passage 130. Referring to FIG. 4, the developer feed trench 210 may be arranged at a height such that its lowermost end is above a rotational axis of the first feeding member 122.

The agitator 220 is rotatably disposed within the developer feed trench 210, to scatter the fed developer and to transport the scattered developer. The agitator 220 has to be provided to scatter and agitate the developer uniformly, along the entire portion of the developer feed trench 210, to prevent any problem from occurring due to arranging the injection portion at an end of the developer feed trench 210.

The plurality of developer feed holes 230 are pierced in the developer feed trench 210 at predetermined intervals, to discharge developer to the developing cartridge 120. The developer feed holes 230 may be formed as slits formed at certain angles with respect to the rotational axis of the agitator 220.

By forming the developer feed holes 230 in a slanted slit configuration, the developer is passed through the developer feed holes 230 and piled in the developing cartridge 120 at a regulated density, thus subsequently preventing a generation of stress while the first feed member 122 conveys the developer to the developing member 121.

The developer feed holes 230 may be formed not to face the developing member 121. If the developer feed holes 230 face the developing member 121, developer from the developer feed holes 230 may directly attach to the developing member 121, without being agitated, and this would result in clotting of replenished developer and failure of the developer to attach to a surface of the developing member 121 with uniform density.

The reset member 310 is arranged above the developing member 121 to receive AC/DC voltage, so as to attract and remove developer residue from the developing member 121. The reset member 310 may have a different structure to comply with a developing manner of the developing unit.

Figure 6:
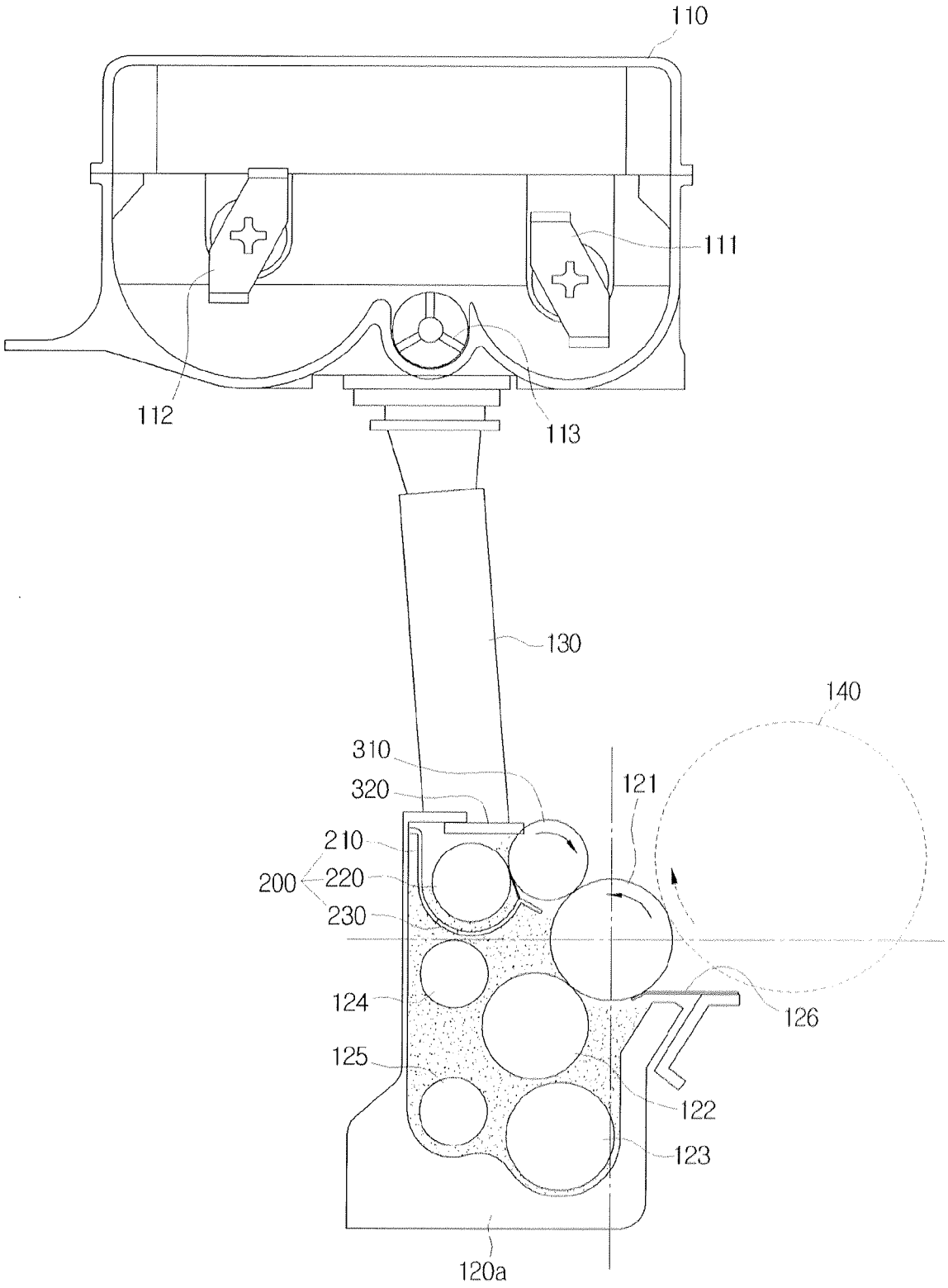
FIG. 6 is a cross section of FIG. 3 according to another example embodiment of the present general inventive concept.

The embodiment as illustrated in FIG. 4 that employs the reset member 310 incorporated into a non-contact developing manner, and the embodiment as illustrated in FIG. 6 that employs the reset member 310 incorporated into a contact developing manner, will be explained in greater detail below.

Figure 5:
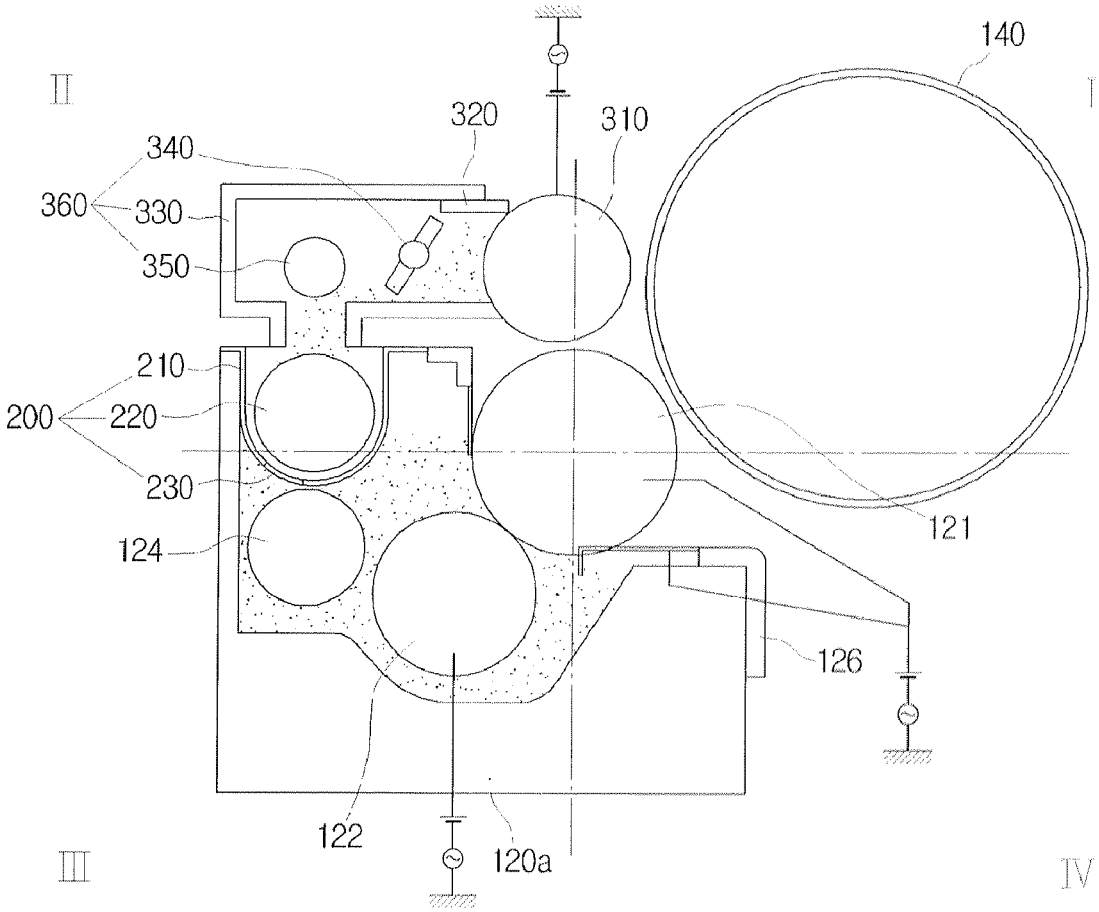
FIG. 5 is a cross section view illustrating a developing casing of an image forming apparatus according to the embodiment as illustrated in FIG. 4.

As mentioned above, the reset member 310 of the developing unit is applied to a non-contact type of development according to the embodiment of the present general inventive concept as illustrated in FIG. 4. Referring to FIGS. 4 and 5, the reset member 310 is at a predetermined distance away from the photosensitive medium 140 and the developing member 121, respectively. The reset member 310 may be at a distance, for example, of about 0.1 mm to about 0.3 mm away from the developing member 121. The developing member 121 may be at a distance, for example, of about 0.3 mm to about 0.7 mm away from the photosensitive medium 140.

It is supposed that the photosensitive medium 140 is in a first quadrant with respect to the developing member 121 as a center, the reset member 310 may be arranged in the second quadrant on an upper side of the developing member 121. Additionally, the first feed member 122 and the first auger 124, which will be explained below, may be arranged in the third quadrant.

A recovery unit 360 may be provided to reuse the developer collected by the reset member 310. The recovery unit 360 includes a recovery casing 330, a recovery auger 340, and a recovery agitating member 350.

Referring to FIG. 4, the recovery casing 330 includes the cleaning member 320 to clean the reset member 310. The recovery casing 330 is connected with the developer feed passage 130 to supply the developer replenish unit 200 with newly fed developer along with the developer recovered from the reset member 310.

The recovery auger 340 is rotatably housed in the recovery casing 330, to agitate the developer to prevent developer agglomerating when the developer is recovered from the reset member 310 by the cleaning member 320, and conveys the recovered developer to the recover agitating member 350.

The recovery agitating member 350 mixes the recovery developer from the recovery auger 340 with new developer supplied from the developer cartridge 110, to supply the new developer and the recovered developer to the developing cartridge 110.

The residual developer from the developing member 121 and the developer scattering in the developing at the photosensitive medium 140 is recovered back to the reset member 310. As a result, contamination of the developing member 121 can be controlled.

The structure of the developing cartridge 120 of the developing unit according to the embodiment of as illustrated in FIG. 4 will be explained below in greater detail.

The developing casing 120*a* houses therein the developing member 121, the first feed member 122, and the first auger 124, with each being rotatable.

The developing member 121 faces the photosensitive medium 140 of FIG. 4, to cause the developer fed by the first feed member 122 to attach onto the electrostatic latent image formed on the surface of the photosensitive medium 140, and thus to visualize the latent image.

The first feed member 122 supplies the developer fed from the developer cartridge 110 to the developing member 121. The first feed member 122 may be charged to have a predetermined electric potential with respect to the developing member 121, so as to transport the developer electrostatically.

The first auger 124 agitates developer when it is supplied from the recover unit 360 and the developer replenish unit 200. The first auger 124 may be positioned to face the plurality of developer feed holes 230.

The developer layer regulating member 126 is provided under the developing member 121, to keep the layer of developer fed from the first feed member 122 on the surface of the developing member 121 above a predetermined thickness.

Figure 7:
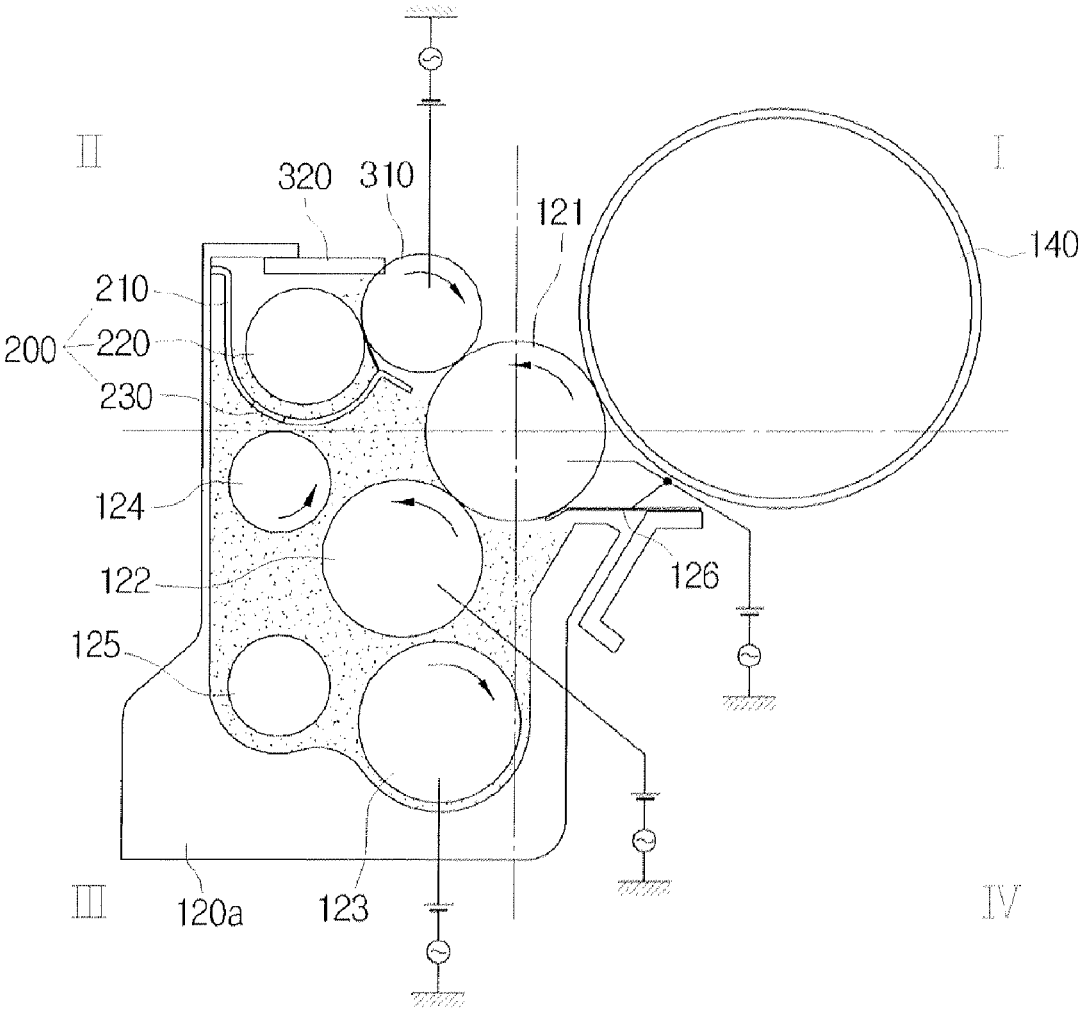
FIG. 7 is a cross section illustrating a developing casing of an image forming apparatus according to the embodiment as illustrated in FIG. 6.

The reset member 310 of the developing unit is applied to a contact-type developing method according to another example embodiment of the present general inventive concept. Referring to FIGS. 6 and 7, the reset member 310 is at a predetermined distance away from the photosensitive medium 140, but contacts the developing member 121 to have nip areas thereon, respectively. In the description of the present embodiment set forth below, the like or same elements as those already explained above with reference to the embodiment as illustrated in FIG. 4 will be referred to by the same reference numerals throughout.

The developer replenish unit 200 includes a developer feed trench 210, an agitator 220, and a plurality of developer feed holes 230.

The developer feed trench 210 can be sized to have a length that corresponds to a width of the developing cartridge 120. The developer feed trench 210 holds therein developer which is fed through the injection portion of the developer feed passage 130. Referring to FIG. 6, the developer feed trench 210 is positioned such that its lowermost end is at a position higher than the rotational axis of the first feed member 122. The reset member 310 may close one of the sidewalls of the developer feed trench 210. The above structure will be explained below in greater detail.

The agitator 220 is rotatably housed in the developer feed trench 210, to scatter and transport the fed developer. The agitator 220 is provided, because the injection portion is formed at an end of the developer feed trench 210 and thus it is necessary to disperse and agitate the fed developer uniformly, over the entire developer feed trench 210.

The plurality of developer feed holes 230 are pierced in the developer feed trench 210 at predetermined intervals from each other, to discharge the developer to the developing cartridge 120. The plurality of developer feed holes 230 may be formed in slit configurations at predetermined angles with respect to the rotational axis of the agitator 220.

The contact-type developing illustrated in the embodiment as illustrated in FIG. 6 does not allow almost any scattering of developer between the photosensitive medium 140 and the developing member 121. However, pressure by contact between the developing member 121 and the first feed member 122 causes stress in developer over time, and this will result in an irregular developer image density.

Therefore, a reset member 310 is disposed above the developing member 121 to recover the residual developer from the developing member 121 to the developer replenish unit 200, and thus to reduce stress of the developer itself.

Referring to FIGS. 6 and 7, the reset member 310 according to the present embodiment is arranged, for example, in the second quadrant, upper side of the developing member 121, if the place where the photosensitive medium 140 is arranged is the first quadrant with respect to the developing member 121. The first and second feed members 122, 123, and the first and second augers 124, 125 may be arranged in the third quadrant, respectively.

The cleaning member 320 is provided above the reset member 310 to clean the developer recovered by the reset member 310, and to recover the developer to the developer replenish unit 200.

The reset member 310 and the cleaning member 320 form one of the sidewalls of the developer feed trench 210. Accordingly, wasted space in the developing unit 120 due to installation of the reset member 310, is prevented.

Because the reset member 310 reduces contamination of the developing member 121, less cleaning is required for the developing member 121 and the first feed member 122, and as a result, developer stress due to friction between the components during operation of the developing unit can be reduced. Furthermore, because friction between the developing member 121 and the first feed member 122 is reduced, the developing member 121 and the first feed member 122 have a longer lifespan.

The reset member 310 may have linear velocity, within a range approximately of ±10% of the linear velocity of the developing member 121. If the reset member 310 has a linear velocity which is too fast, it is difficult to adsorb scattered developer and residual developer adequately, and if the reset member 310 has a linear velocity which is too slow, cleaning of scattered developer and residual developer of the developing member 121 becomes inefficient.

The structure of the developing cartridge 120 according to the embodiment as illustrated in FIG. 6 will be explained in detail.

The developing casing 120*a* houses therein the developing member 121, the first and second feed members 122 and 123, and the first and second augers 124 and 125, with each being rotatable.

The developing member 121 faces the photosensitive medium 140 of FIG. 4, to cause the developer fed by the first and second feed member 122 and 123 to attach onto the electrostatic latent image formed on the surface of the photosensitive medium 140, and thus to visualize the latent image.

The first and second feed members 122 and 123 supply the developer fed from the developer cartridge 110 to the developing member 121. To this end, the first and second feed members 122 and 123 may be charged to have a predetermined electric potential with respect to the developing member 121, so as to transport the developer electrostatically.

The first and second augers 124 and 125, formed with a same diameter, agitate the fed developer, while conveying the developer in opposite directions.

The first auger 124 is positioned to face the plurality of developer feed holes 230, and the second auger 125 is provided under the first auger. The first and second augers 124 and 125 operate to prevent developer agglomeration on a bottom of the developing casing 120*a*.

The developer layer regulating member 126 is provided under the developing member 121, to keep the layer of developer fed from the first feed member 122 on the surface of the developing member 121 above a predetermined thickness.

Referring to FIG. 6, the rotational axis of the first feed member 122 is at a height lower than the rotational axis of the first auger 124, but above the rotational axis of the second auger 125. The rotational axis of the second feed member 123 may also be placed at a height lower than the rotational axis of the second auger 125.

The first and second feed members 122 and 123 are arranged in a manner explained above, because each have different roles to perform. The first feed member 122, along with the first auger 124, is placed as close as possible to the developer replenish unit 200, to transmit the developer from the developer replenish unit 200 to the developing member 121 more efficiently.

The second feed member 123 operates to transmit the developer being peeled off from the developer layer regulating member 126 back to the first feed member 122. Therefore, the second feed member 123 is placed at a height lower than the first feed member 122 to transport the developer piling on the bottom of the developing cartridge body 121*a* upwards to the first feed member 122. The second auger 125 may also be arranged at a height lower than the first auger 124, to prevent developer agglomeration on the bottom of the developing cartridge body 121*a*.

Accordingly, the first feed member 122 is positioned to face the developing member 121, and the second feed member 123 is positioned to face the first feed member 122.

Referring to FIG. 7, both the first and second feed members 122 and 123 are implemented as roller members. However, one skilled in the art will understand that this should not be constructed as limiting. As a need arises, a variety of modifications can be made regarding the configuration of the first and second feed members 122 and 123. For example, the second feed member 123 may be implemented as an agitator which has a plurality of blades.

The developing member 121, the first and second feed members 122 and 123, and the developer layer regulating member 126 may receive a certain level of voltage, such as AC/DC voltage, for example.

The developing member 121, the first and second feed members 122 and 123, the first and second augers 124 an 125, and the reset member 310 correspond to each other in length, to maximize developer agitating efficiency. For example, the first and second augers 124, 125 may transport the fed developer in the developing unit 120 vertically and horizontally, preventing developer agglomeration, and the developing member 121 and the reset member 310 mix the stress-generated developer and the newly-fed developer, again preventing agglomeration of stress-generated developer, and also reducing friction between the developing member 121 and the first feed member 122.

The developer may be kept at a reference developer level that is above the developer feed holes 230. Although not illustrated, a developer sensor having a light emitting portion and a light receiving portion may be disposed above the developer feed holes 230, to ensure that the developer is kept at a developer level above the developer feed holes 230. As a result, agglomeration of replenished developer is reduced.

The developing unit according to various embodiments of the present general inventive concept explained above is applicable to both monochromatic and color image forming apparatuses. When applied in the color image forming apparatus, a plurality of developing units need be provided.

According to various embodiments of the present general inventive concept explained above, expenditure for consumables is reduced, because a developer cartridge is separately provided. Additionally, efficient developer agitation is provided.

Furthermore, a consistent image quality is achieved, because a plurality of augers move vertically and horizontally to circulate developer inside a developing unit. Furthermore, less stress is exerted to developer during developing process, because stress-generated developer is recovered by a reset member positioned above a developing member, and mixed with newly-fed developer. Furthermore, friction between the developing member and a feeding member is reduced, subsequently increasing a lifespan of the involved components, because the reset member removes residual developer from the developing member.

Although various embodiments of the present general inventive concept have been illustrated and described, it will be appreciated by those skilled in the art that changes may be made in these embodiments without departing from the principles and spirit of the general inventive concept, the scope of which is defined in the appended claims and their equivalents.

What is claimed is:

1. A developing unit usable with an image forming apparatus, the developing unit comprising:

a developing member to develop an electrostatic latent image on a photosensitive medium with developer;

a first feed member to feed the developer to the developing member;

a developer layer regulating member located below the developing member and in contact with the developing member, to regulate the thickness of developer layer attached to a surface of the developing member; and a reset member disposed above the developing member to reset the developing member by recovering residual developer from the developing member.

2. The developing unit of claim 1, wherein the reset member and the photosensitive medium are at a distance in a range from about 0.3 mm to about 0.7 mm away from each other, and the photosensitive medium and the developing member are at a distance in a range from about 0.1 mm to about 0.3 mm away from each other, respectively.

3. The developing unit of claim 2, further comprising:

a recovery unit to agitate the developer being recovered from the reset member and to transport the developer, the recovery unit comprising:

a recovery casing housing a cleaning blade to clean the reset member therein;

a recovery auger to transport the developer being recovered by the cleaning blade; and a recovery agitating member to agitate the developer recovered.

4. The developing unit of claim 3, wherein the reset member forms one of a plurality of sidewalls of the recovery unit.

5. The developing unit of claim 4, wherein the reset member, if in contact with the developing member, has a linear velocity in an approximately ±10% range.

6. The developing unit of claim 1, further comprising a second feed member placed at a height lower than a rotational axis of the first feed member.

7. The developing unit of claim 1, further comprising:

a removable developer cartridge.

8. The developing unit of claim 7, further comprising:

a developing cartridge;

a developer feed passage to feed developer of the developer cartridge to the developing cartridge; and a developer replenish unit, connected with a connecting area between the developing cartridge and the developer feed passage, to agitate developer fed along the developer feed passage, and to feed the agitated developer to the developing cartridge.

9. The developing unit of claim 4, wherein the reset member forms one of the plurality of sidewalls of the developer replenish unit.

10. The developing unit of claim 8, wherein the developer replenish unit comprises:

a developer feed trench disposed along a length of the developing cartridge, to receive developer being fed along the developer feed passage; and an agitator to transport the received developer along the developer feed trench.

11. The developing unit of claim 10, wherein the developer replenish unit further comprises:

a plurality of developer feed holes pierced in the developer feed trench at predetermined intervals from each other, to discharge the developer to the developing cartridge, wherein the plurality of developer feed holes are slits formed at predetermined angles with respect to a rotational axis of the agitator and are placed in a position that does not face the developing member.

12. The developing unit of claim 8, wherein the developer feed passage is made from a flexible material and is connected with the developer cartridge and with one end of the developing cartridge, respectively.

13. The developing unit of claim 7, wherein the developer cartridge comprises:

a plurality of first agitating members; and a second agitating member to agitate developer being discharged to a developer feed passage to which the developer cartridge is coupled, wherein the second agitating member is in a position proximate to an entrance to the developer feed passage.

14. The developing unit of claim 8, wherein the developing cartridge comprises:

a plurality of augers to agitate developer being fed from the developer replenish unit.

15. The developing unit of claim 14, wherein the plurality of augers are formed having a same diameter, and include first and second augers to convey fed developer in opposite directions, wherein the first auger is placed in a position to face the developer feed holes, and the second auger is placed below the first auger.

16. The developing unit of claim 15, wherein the first feed member is placed at a height lower than the first auger and above the second auger, and the second feed member is placed at a height lower than the second auger.

17. The developing unit of claim 15, wherein the developing member, the first and second feed members, and the first and second augers correspond to each other in length; and the developer feed trench is placed in a position where its lowermost end is at a height above a rotational axis of the first feed member.

18. The developing unit of claim 11, wherein a reference developer level is above the developer feed holes; and the developer is a uni-component, non-magnetic developer.

19. The developing unit of claim 1, wherein the reset member to reset the developing member is not submerged in the developer.

20. An image forming apparatus, comprising:

a main body to form an appearance of the image forming apparatus;

a developing member to develop an electrostatic latent image on a photosensitive medium with developer;

a first feed member to feed the developer to the developing member;

a developer layer regulating member located below the developing member and in contact with the developing member, to regulate the thickness of developer layer attached to a surface of the developing member; and a reset member disposed above the developing member to reset the developing member by recovering residual developer from the developing member, wherein the reset member is not submerged into the developer.

21. An image forming apparatus, comprising:

a removable developer cartridge; and a developing cartridge comprising:

a developing member to develop an electrostatic latent image on a photosensitive medium with developer;

a first feed member to feed the developer to the developing member;

a developer layer regulating member located below the developing member and in contact with the developing member, to regulate the thickness of developer layer attached to a surface of the developing member; and a reset member disposed above the developing member to reset the developing member by recovering residual developer from the developing member.

22. The image forming apparatus of claim 21, further comprising:

a developer feed passage to feed developer of the developer cartridge to the developing cartridge; and a developer replenish unit, connected with a connecting area between the developing cartridge and the developer feed passage, to agitate developer fed along the developer feed passage, and to feed the agitated developer to the developing cartridge.

23. A reset member usable with an image forming apparatus, the reset member comprising:

a reset portion disposed above a developing member to reset the developing member by recovering residual developer from the developing member, wherein the reset member is not submerged in developer in its initial position.

24. The reset member of claim 23, wherein the reset portion is formed opposite to a developer feed member to feed developer to the developing member which is interposed between the reset portion and the developer feed member, and the reset portion, along with the developing member and the developer feed member, are formed as roller members.

25. A developing unit usable with an image forming apparatus, the developing unit comprising:

a developing cartridge having a photosensitive medium to form an electrostatic image thereon and a developing member to provide developer to the photosensitive medium; and a developer feeding passage having a developer cartridge receiving portion on one end and an other end connected to the developing cartridge, wherein a detachably mounted developer cartridge having one or more agitators attaches to the other end of the developer feeding passage; and residual developer recovered during the forming of the electrostatic image is mixed with the developer as it is delivered from the developer feeding passage.

26. A developing unit usable with an image forming apparatus, the developing unit comprising:

a developing member to develop an electrostatic latent image on a photosensitive medium with developer;

a first feed member to feed the developer to the developing member; and a reset member disposed above the developing member to reset the developing member;

wherein the reset member and the photosensitive medium are at a distance in a range from about 0.3 mm to about 0.7 mm away from each other, and the photosensitive medium and the developing member are at a distance in a range from about 0.1 mm to about 0.3 mm away from each other, respectively.

* * * * *